US007566841B2

(12) United States Patent
McCoy

(10) Patent No.: US 7,566,841 B2
(45) Date of Patent: Jul. 28, 2009

(54) TIE BAR FOR TWO POLE SWITCHING DEVICE

(75) Inventor: Brian Timothy McCoy, Lawrenceville, GA (US)

(73) Assignee: Siemens Energy & Automation, Inc., Norcross, GA (US)

( * ) Notice: Subject to any disclaimer, the term of this patent is extended or adjusted under 35 U.S.C. 154(b) by 0 days.

(21) Appl. No.: 11/983,339

(22) Filed: Nov. 8, 2007

(65) Prior Publication Data

US 2008/0135391 A1 Jun. 12, 2008

Related U.S. Application Data

(60) Provisional application No. 60/865,068, filed on Nov. 9, 2006.

(51) Int. Cl.
*H01H 17/00* (2006.01)

(52) U.S. Cl. ..... 200/331; 200/50.01; 335/8; 335/21

(58) Field of Classification Search ..... 200/331–332, 200/334, 307, 18, 47, 50.01, 50.06, 50.16, 200/50.19; 335/8–10, 21, 132, 202, 167
See application file for complete search history.

(56) References Cited

U.S. PATENT DOCUMENTS

| | | | |
|---|---|---|---|
| 3,505,621 | A | 4/1970 | Knecht |
| 6,034,581 | A | 3/2000 | DiMarco et al. |
| 2002/0050877 | A1 | 5/2002 | Swartzentruber et al. |

FOREIGN PATENT DOCUMENTS

| | | |
|---|---|---|
| DE | 1563919 A1 | 4/1970 |
| GB | 2063566 A | 6/1981 |

*Primary Examiner*—Kyung Lee
(74) *Attorney, Agent, or Firm*—Jose de la Rosa

(57) ABSTRACT

A multipole switching device for selectively switching electrical power from an electrical power source to a load circuit comprises a first control device comprising a housing, an electromechanical actuator in the housing including a movable plunger, and an electrical switch in the housing operated by the plunger. A second control device comprises a housing mountable adjacent the first control device, an electromechanical actuator in the housing including a movable plunger, and an electrical switch in the housing operated by the plunger. A tie linkage mechanically ties the first control device plunger to the second control device plunger.

13 Claims, 9 Drawing Sheets

TIE BAR FOR TWO POLE SWITCHING DEVICE

CROSS REFERENCE TO RELATED APPLICATIONS

This application claims priority of provisional application No. 60/865,068 filed Nov. 9, 2006, the contents of which is incorporated by reference herein.

FIELD OF THE INVENTION

This invention relates generally to residential and commercial electrical power distribution panels and components, and more particularly, to a tie bar for a two pole switching device for controlling loads, particularly lighting loads and air conditioning loads, in an electrical power distribution system.

BACKGROUND OF THE INVENTION

Circuit breaker panels are used to protect electrical circuitry from damage due to an overcurrent condition, such as an overload, a relatively high level short circuit, or a ground fault condition. To perform that function, circuit breaker panels include circuit breakers that typically contain a switch unit and a trip unit. The switch unit is coupled to the electrical circuitry (i.e., lines and loads) such that it can open or close the electrical path of the electrical circuitry. The switch unit includes a pair of separable contacts per phase, a pivoting contact arm per phase, an operating mechanism, and an operating handle.

In the overcurrent condition, all the pairs of separable contacts are disengaged or tripped, opening the electrical circuitry. When the overcurrent condition is no longer present, the circuit breaker can be reset such that all the pairs of separable contacts are engaged, closing the electrical circuitry.

In addition to manual overcurrent protection via the operating handle, automatic overcurrent protection is also provided via the trip unit. The trip unit, coupled to the switch unit, senses the electrical circuitry for the overcurrent condition and automatically trips the circuit breaker. When the overcurrent condition is sensed, a tripping mechanism included in the trip unit actuates the operating mechanism, thereby disengaging the first contact from the second contact for each phase. Typically, the operating handle is coupled to the operating mechanism such that when the tripping mechanism actuates the operating mechanism to separate the contacts, the operating handle also moves to a tripped position.

Switchgear and switchboard are general terms used to refer to electrical equipment including metal enclosures that house switching and interrupting devices such as fuses, circuit breakers and relays, along with associated control, instrumentation and metering devices. The enclosures also typically include devices such as bus bars, inner connections and supporting structures (referred to generally herein as "panels") used for the distribution of electrical power. Such electrical equipment can be maintained in a building such as a factory or commercial establishment, or it can be maintained outside of such facilities and exposed to environmental weather conditions. Typically, hinge doors or covers are provided on the front of the switchgear or switchboard sections for access to the devices contained therein.

In addition to electrical distribution and the protection of circuitry from overcurrent conditions, components have been added to panels for the control of electrical power to loads connected to circuit breakers. For example, components have been used to control electrical power for lighting.

One system used for controlling electrical power to loads utilizes a remote-operated circuit breaker system. In such a system, the switch unit of the circuit breaker operates not only in response to an overcurrent condition, but also in response to a signal received from a control unit separate from the circuit breaker. The circuit breaker is specially constructed for use as a remote-operated circuit breaker, and contains a motor for actuating the switch unit.

In an exemplary remote-operated circuit breaker system, a control unit is installed on the panel and is hard-wired to the remote-operated circuit breaker through a control bus. When the switch unit of the circuit breaker is to be closed or opened, an operating current is applied to or removed from the circuit breaker motor directly by the control panel. Additional, separate conductors are provided in the bus for feedback information such as contact confirmation, etc., for each circuit breaker position in the panel. The control unit contains electronics for separately applying and removing the operating current to the circuit breakers installed in particular circuit breaker positions in the panel. The panel control unit also has electronics for checking the state of the circuit breaker, diagnostics, etc. One advantage of that system is that the individual circuit breakers can be addressed according to their positions in the panel.

Operation of remote operated circuit breakers becomes more difficult when the need exists for a two or three pole unit to provide multiple sets of switching contacts for the control of air conditioning and meter loads. A plurality of single pole devices may be operated at the same time to simulate a multipole device. However, timing issues exist with such a configuration. Also, if one of the devices fails or is operated oppositely to that intended improper load operation could result. Moreover, separate control circuitry is necessary for each of the individual single pole units. Previously, such circuitry has been external to the switching device due to component size and the amount of power required. Locating communication circuitry outside the switching device necessitates the circuitry always being present in the panelboard even if the switching device is not.

Alternatively, or additionally, the contact arms of multipole devices are mechanically linked by a crossbar that normally pivots at the same point as the contact arms and ensures that the contact arms move/rotate at the same time. However, the use of a crossbar may not be feasible with modular devises, or the like. It is necessary that the individual poles be in the same on/off position, while still allowing sufficient provisions for the over travel of any individual pole as a result of contact wear and tolerance issues.

The present invention is directed to a tie bar in a two pole switching device.

SUMMARY OF THE INVENTION

In accordance with the invention, there is provided a tie bar in a two pole switching device in an electrical power distribution system.

In accordance with one aspect of the invention, there is disclosed a multipole switching device for selectively switching electrical power from an electrical power source to a load circuit. The switching device comprises a first control device comprising a housing, an electromechanical actuator in the housing including a movable plunger, and an electrical switch in the housing operated by the plunger. A second control device comprises a housing mountable adjacent the first control device, an electromechanical actuator in the housing including a movable plunger, and an electrical switch in the housing operated by the plunger. A tie linkage mechanically ties the first control device plunger to the second control device plunger.

It is a feature of the invention that the tie linkage comprises first and second wrist pins operatively associated with the respective first control device plunger and the second control device plunger.

The tie linkage may further comprise a tie bar operatively coupled to the first and second wrist pins. The tie bar may comprise a flange having opposite tubular hubs receiving the first and second wrist pins. The flange may be sandwiched between the first control device housing and the second control device housing. Particularly, the flange may be received in a recess in each of the first control device housing and the second control device housing.

It is still another feature of the invention that the flange blocks cross accumulation of debris from pole to pole.

It is another feature of the invention that the first wrist pin mechanically links the plunger to a contact arm of the first electrical switch and the second wrist pin mechanically links the plunger to a contact arm of the second electrical switch.

It is a further feature of the invention that the electromechanical actuators comprise solenoids that are retained in one state by a permanent magnet.

It is still another feature of the invention that the tie linkage comprises a plastic tie bar.

There is disclosed in accordance with another aspect of the invention a two pole switching device for selectively switching electrical power from an electrical power source to a load circuit comprising a first control module and a second control module. Each control module comprises a housing, an electromechanical actuator in the housing including a movable plunger, and an electrical switch in the housing comprising a fixed contact and a movable contact, the movable contact being carried on a contact arm operated by the plunger. A tie linkage mechanically ties the first control module contact arm to the second control module contact arm.

Further features and advantages of the invention will be readily apparent from the specification and the drawings.

DETAILED DESCRIPTION OF THE INVENTION

An electrical distribution system, such as an integrated lighting control system, in accordance with the invention permits a user to control power circuits typically used for lighting, as well as circuits for resistive heating or air conditioning, using multipole remote operated relays. The electrical distribution system may be as is generally described in U.S. application Ser. No. 11/519,727, filed Sep. 12, 2006, the specification of which is incorporated by reference herein, or as is more specifically described in U.S. application Ser. No. 11/635,299, filed Dec. 7, 2006, the specification of which is incorporated by reference herein.

Figure 1:
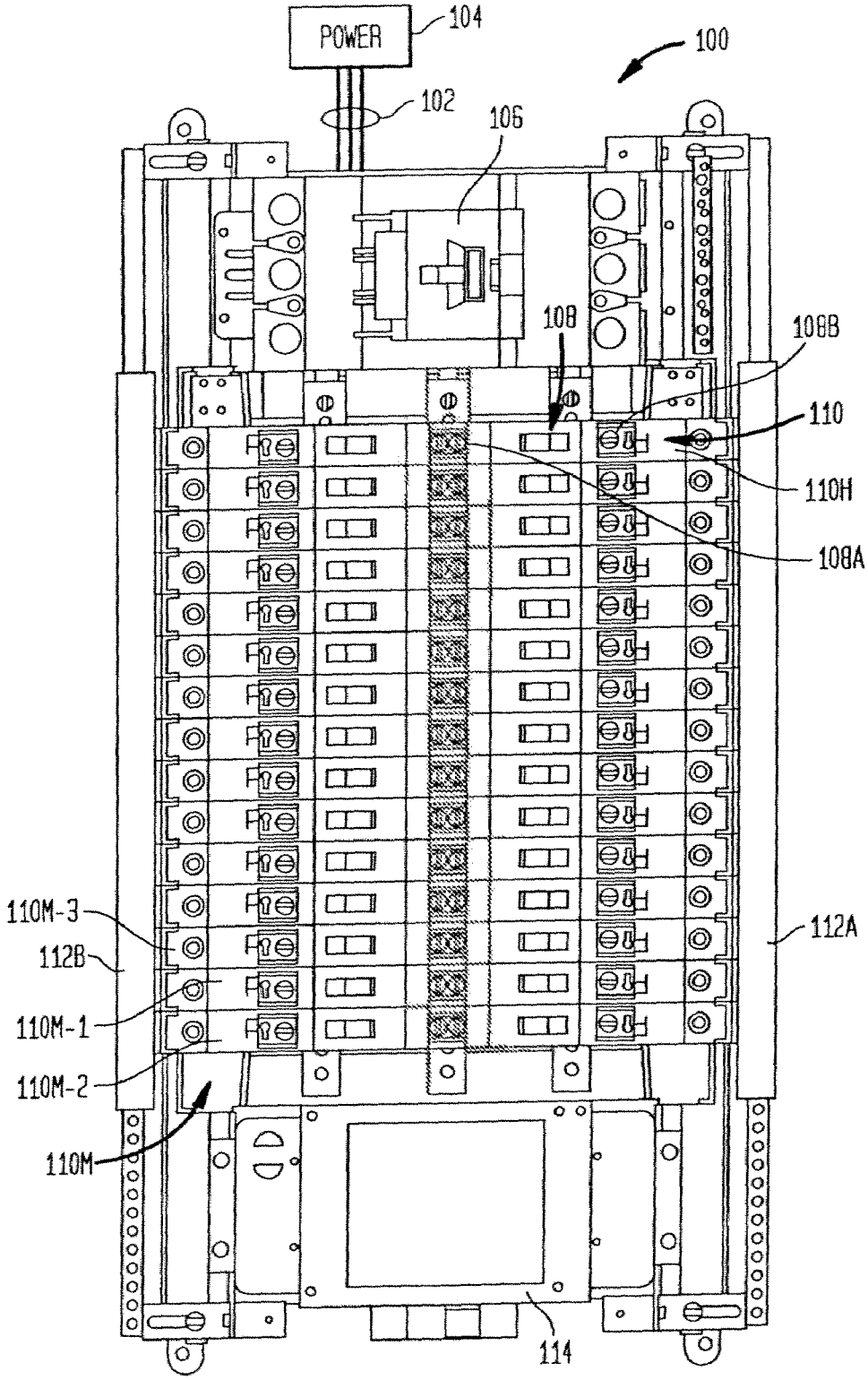
FIG. 1 is an elevation view of a power distribution panel according to the invention.

Referring to FIG. 1, a lighting control system in accordance with the invention comprises a lighting control panel 100. The panel 100 may comprise a Siemens type P1 panelboard, although the invention is not limited to such a configuration. Line power enters the panel 100 through power source cables 102 connected to a source of power 104. Line power may, for example, be a three phase 480Y277, 240 or 120 VAC power source, as is conventional. The cables 102 are electrically connected to an input side of a main breaker 106. The main breaker 106 distributes line power to individual circuit breakers 108 in a conventional manner. How the power is distributed depends on design of the individual circuit breakers 108, as will be apparent to those skilled in the art. The power is distributed to the line side of individual circuit breakers 108. The panel 100 may be configured to accept forty two or more individual circuit breakers 108, although only thirty are shown in the embodiment of FIG. 1. Each circuit breaker may be of conventional construction and may be, for example, a Siemens BQD circuit breaker. Each circuit breaker 108 includes a line terminal 108A receiving power from the main breaker 106 and a load terminal 108B conventionally used for connecting to a load circuit.

For simplicity of description, when a device such as a circuit breaker 108 is described generally herein the device is referenced without any hyphenated suffix. Conversely, if a specific one of the devices is described it is referenced with a hyphenated suffix, such as 108-1.

In accordance with the invention, each load circuit to be controlled also has a remote operated device or control module 110, in the form of a relay, a meter or a dimmer. The term remote operated device as used herein includes any other devices that controls, monitors or may otherwise be used in a load circuit, in accordance with the invention. While in a preferred embodiment, the remote operated device 110 is a separate component from the circuit breaker 108, the term "remote operated device" as used herein encompasses devices integral with the circuit breaker. The remote operated devices 110 are also connected to data rails 112A and 112B. A panel controller 114 controls the remote operated devices 110 through connections provided via the data rails 112A and 112B, as discussed below.

The remote operated device 110, in the form of a relay embodiment, includes a housing 110H encasing an auxiliary set of contacts that can be remotely operated to open and close a lighting circuit. The device 110 is attached to the load side of a circuit breaker 108 within a panel 100 using a conductor tab, i.e, the terminal 110A, inserted into the breaker lug 108B, see FIG. 2. The load terminal 110B comprises a lug of the same size as the breaker lug 108B for connecting to a wire to be connected to the load device. The device housing 110H is configured to mount in a Siemens type P1 panelboard, although the invention is not limited to such a configuration.

Figure 2:
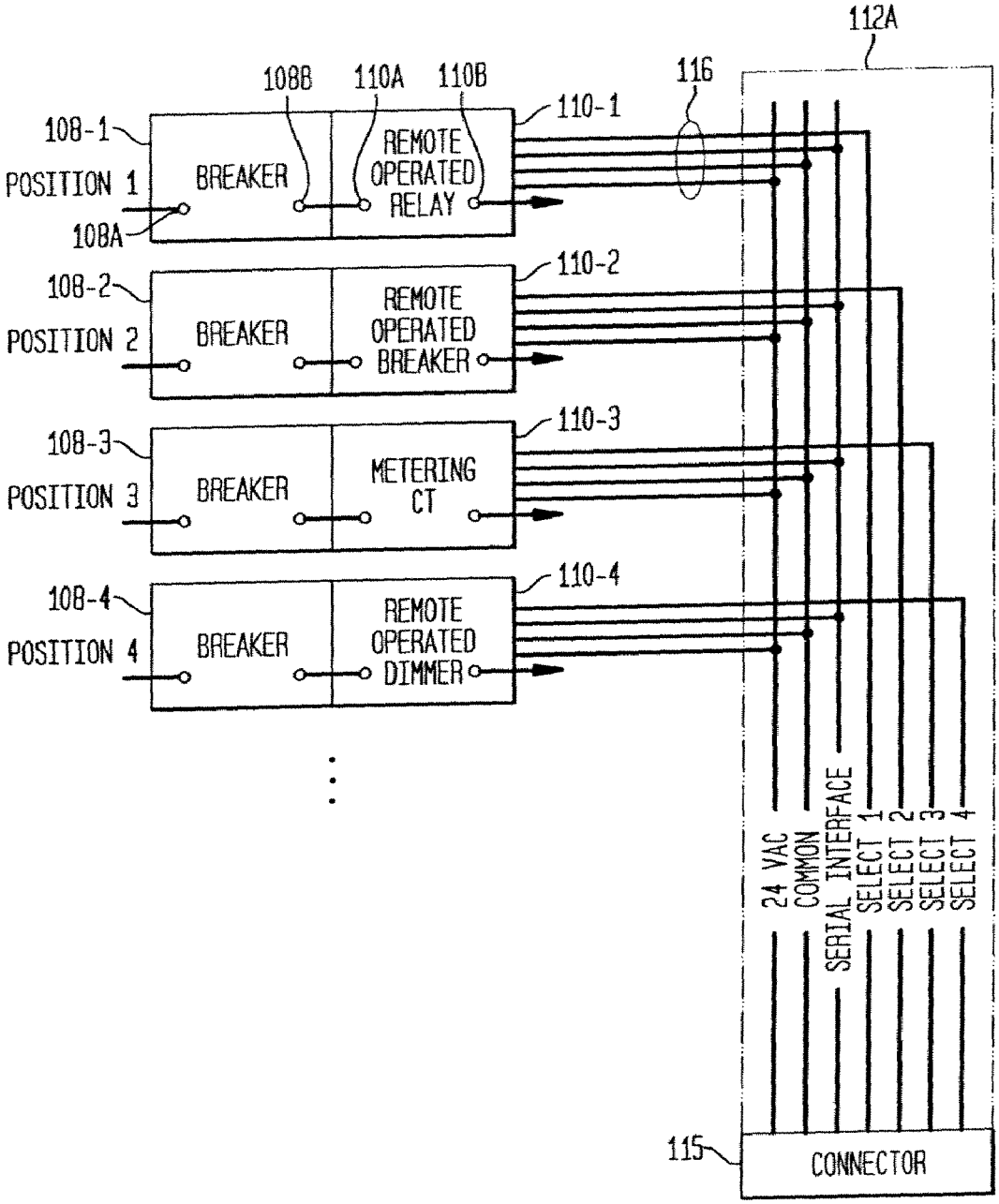
FIG. 2 is a block diagram illustrating pairs of circuit breakers and remote operated devices of the power distribution panel of FIG. 1.

Referring to FIG. 2, a block diagram illustrates four circuit breakers 108-1, 108-2, 108-3 and 108-4, and respective associated remote operated devices 110-1, 110-2, 110-3 and 110-4. In the illustrated embodiment, the first device 110-1 comprises a relay, the second device 110-2 comprises a breaker, the third device 110-3 comprises a current transformer, and the fourth device 110-4 comprises a dimmer. As is apparent, any combination of these remote operated devices 110 could be used. Each remote operated device 110 includes an input terminal 110A electrically connected to the associated circuit breaker load terminal 108B, and an output terminal 110B for connection to a load device.

The data rail 112 is mechanically attached directly to the interior of the lighting control panel 100. The data rail 112 comprises a shielded communication bus including a ribbon connector 115 having conductors to be routed to the panel controller 114.

A detailed description of the data rail 112 and panel controller 114 are not provided herein. Instead, reference may be made to the detailed discussion of the same in the applications incorporated by reference herein. Indeed, the present invention does not require use of either a panel controller or data rail, as will be apparent.

The remote operated device 110, in the form of a relay, allows remote switching of an electrical branch load. The device 110 is designed to fit inside a standard electrical panel board with forty-two or more branch circuit breakers 108. The device 110 is an accessory to a branch circuit breaker 108 allowing repetitive switching of the load without effecting operation of the circuit breaker 108.

The remote operator device 110 requires a means to receive command signals to open or close and to report back successful operation or device status. Also required is a means to drive opening and closing of the switch mechanism contacts. In accordance with the invention, the remote operator device is a multipole switching device that uses two magnetically held solenoids as an actuator device and one electronic circuit board similar to a single pole device with a tie linkage mechanically linking the devices. With this design, electronic control circuitry is located inside the switching device itself. Only one circuit is needed to operate both actuators. The use of two magnetically held solenoids or "mag latches" as switching actuators results in very low energy requirements, requires short duration pulses to change position (measured in milliseconds), provides accurate and repeatable timing and requires that the control must reverse voltage polarity.

Figure 3:
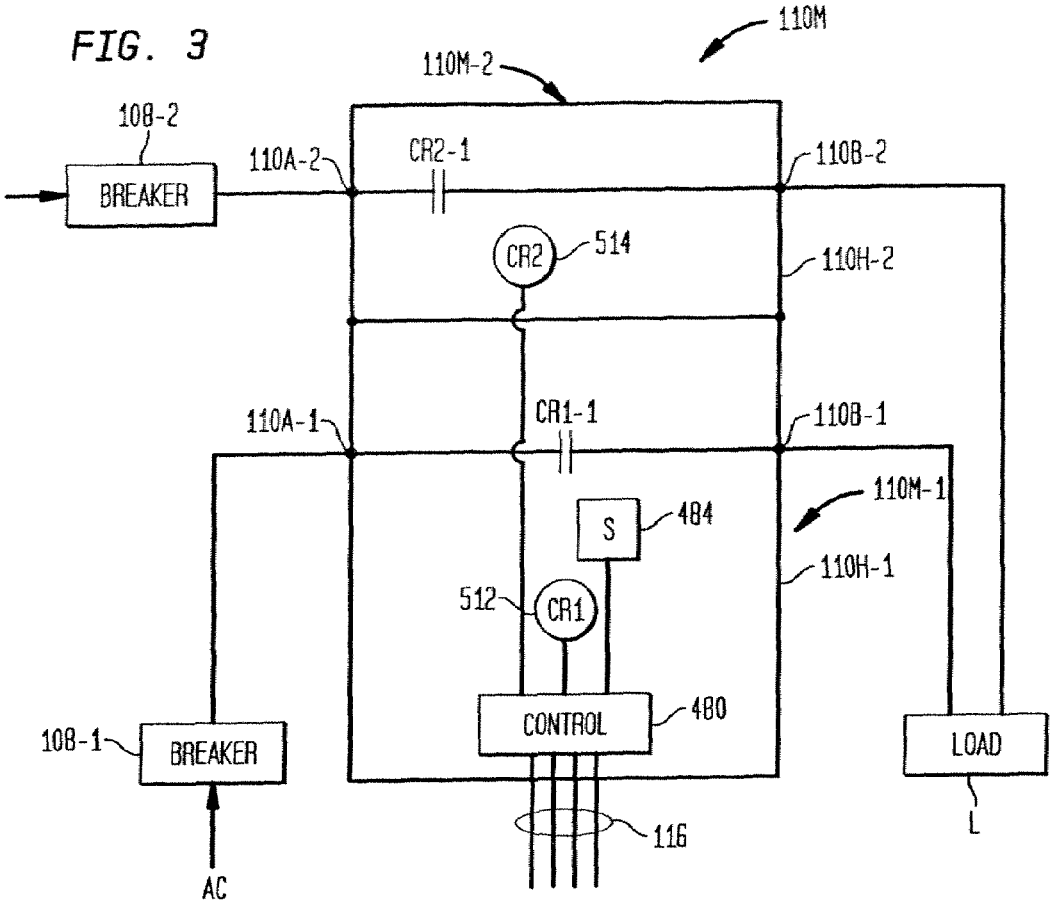
FIG. 3 is a basic block diagram of a multipole remote operated control module in accordance with the invention.

FIG. 3 illustrates a basic block diagram for two pole load switching. The remote operated device, in the form of a two pole switching device 110M includes a first control module 110M-1 and a second control module 110M-2 having respective side-by-side housings 110H-1 and 110H-2, as generally illustrated. The two pole switching device 110M occupies two positions in the panel 100. A control circuit 480 in the first housing 110H-1 is connected to a cable 116 for connection to the data rail 112, see also FIG. 2. The control circuit 480 drives two control relays CR1 and CR2, in the respective housings 110H-1 and 110H-2, each operating an electrical switch CR1-1 and CR2-1 in the form of a normally open contact connected between terminals 110A-1 and 110B-1, and 110A-2 and 110B-2, respectively. A sensor 484 senses status of the relays CR1 and CR2 and is connected to the control circuit 480. As such, the control circuit 480 controls operation of the contacts CR1-1 and CR2-1 to selectively electrically connect a load L to the breakers 108-1 and 108-2, and thus to power the load L.

Figure 4:
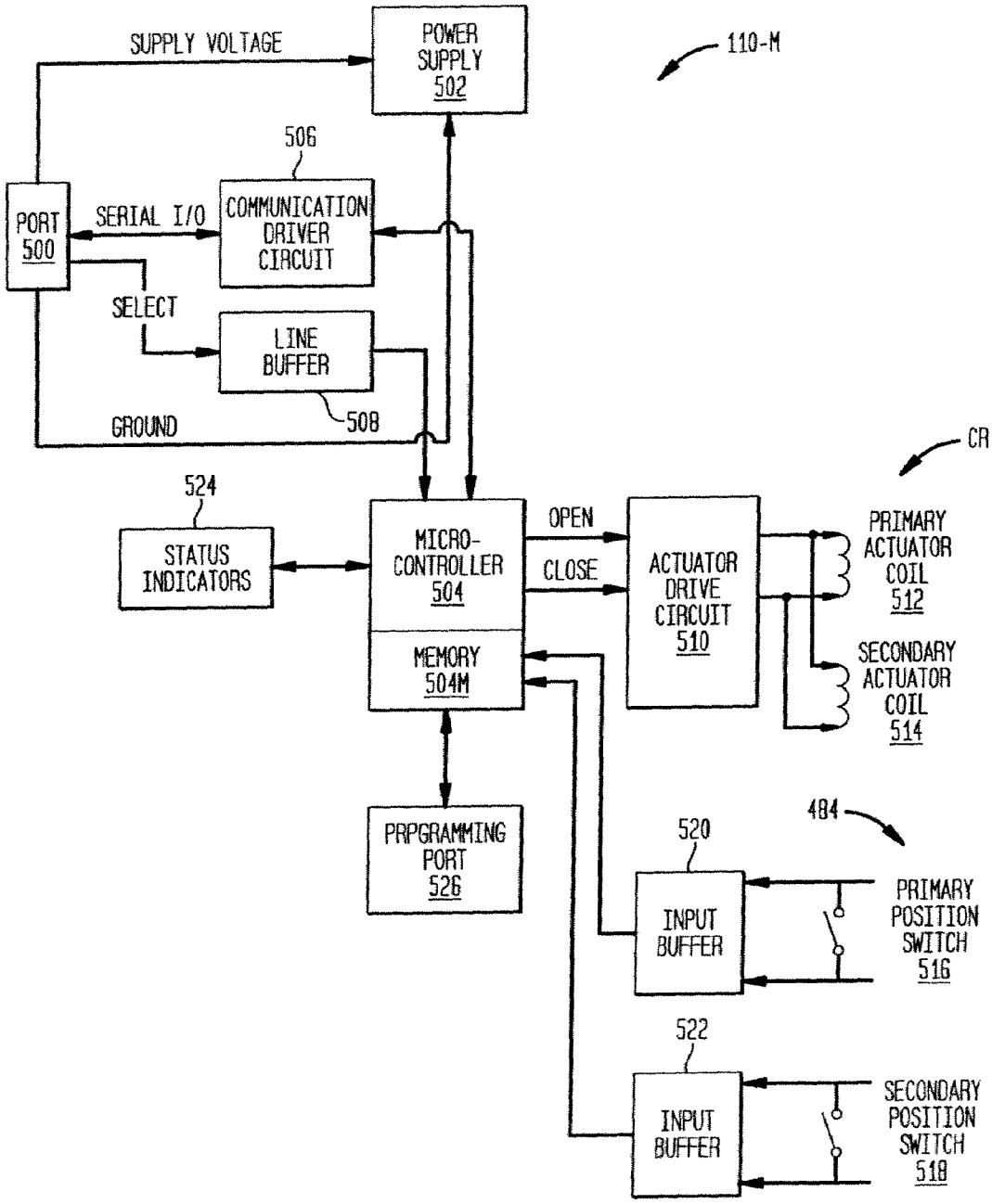
FIG. 4 is a detailed block diagram of the multipole remote operated control module of FIG. 3.

FIG. 4 illustrates a detailed block diagram of the two pole switching device 110-M. Connection to the data rail 112 is through a four wire port 500. The port 500 includes a positive supply voltage and ground, a serial communication line, and a select line, as discussed above. The supply voltage and ground are fed to a power supply 502 to generate voltage as needed for a microcontroller 504 and other circuits. A communication driver circuit 506 is used to isolate and drive a single wire serial communication line between the microcontroller 504 and the port 500 and thus the data rail 112. As discussed above, the single wire connection to each remote operated device 110 and to the panel controller 114 is used to transmit and receive commands and data. This provides necessary isolation and protection. In the event of an individual device failure, the remainder of the devices continue to operate properly. The select line from the port 500 is buffered in a line buffer 508 and connected to the microcontroller 504. This select line is used to enable or disable communications to and from the remote operated device 110-M. By selecting more than one remote operated device, the I/O controller 124 can send commands or messages to multiple devices 110 at the same time, reducing traffic on the serial communication bus.

The microcontroller 504 comprises a conventional microcontroller and associated memory 504M, the memory storing software to run in the microcontroller 504.

Figure 5:
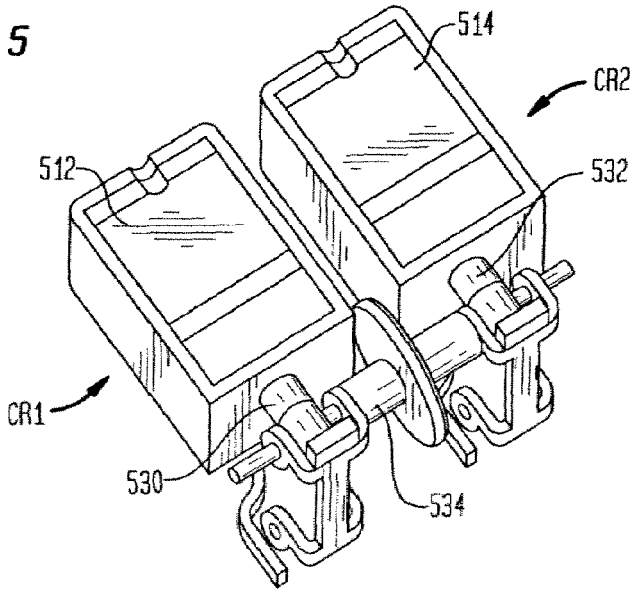
FIG. 5 is a perspective view illustrating mechanical linking of solenoids in the multipole remote operated switching device of FIG. 3.

The microcontroller 504 has OPEN and CLOSE lines to an actuator drive circuit 510. The control relays CR1 and CR2 in the illustrated embodiment of the invention comprise magnetically held solenoids including a primary actuator coil 512 and a secondary actuator coil 514, see also FIG. 5, connected in parallel to the actuator drive circuit 510. The actuator drive circuit 510 provides current for both coils 512 and 514. An OPEN signal causes the drive circuit to apply negative voltage to the actuator coils for a short period of time (about 10 to 30 milliseconds). This causes actuator plungers 530 and 532 to pull-in and become magnetically latched or held in the open position to open the contacts CR1-1 and CR2-1, see FIG. 3, in a conventional manner. The plungers 530 and 532 are mechanically linked by a tie bar 534. Power is then removed from the coils 512 and 514. A CLOSE signal from the microcontroller 504 causes the drive circuit 510 to apply a positive voltage to the actuator coils 512 and 514 for a shorter period of time (about 2 to 3 milliseconds). This period of time is sufficient for the actuator plungers 530 and 532 to become unlatched or released and springs force them to the closed position to close the contacts CR1-1 and CR2-1, see FIG. 3. Again, power is then removed from the coils 512 and 514. Since the actuators are stable in both the open and closed positions, energy is only required to change position. This results in a low energy solution even with two coils in parallel. Also included in the actuator drive circuit 510 is protection from both open and closed signals applied at the same time, which could result in a short circuit of the power supply 502.

Feedback for actuator plunger positions is provided by the sensor 484 in the form of two auxiliary position switches, a primary position switch 516 and a secondary position switch 518, such as auxiliary relay contacts. The signals are buffered in respective input buffers 520 and 522 and then connected to the microcontroller 504. The microcontroller 504 uses the feedback information to respond to an I/O controller request for status or to retry a failed open or close attempt.

Additionally, the microcontroller 504 can send signals to various types of status indicators 524 such as LEDs to show open, closed, communications OK, operating properly, low voltage, etc. A programming port 526 can be used to program or update the microcontroller software or to load parameters such as on/off pulse rates or to troubleshoot the device 110.

Referring to FIGS. 6-13, the two pole switching device 110M with a tie bar 534 in accordance with the invention is illustrated. The two pole switching device 110M comprises the first control module 110M-1 and the second control module 110M1-2 mounted adjacent to one another in the lighting control panel 100, as illustrated in FIG. 1.

Figure 11:
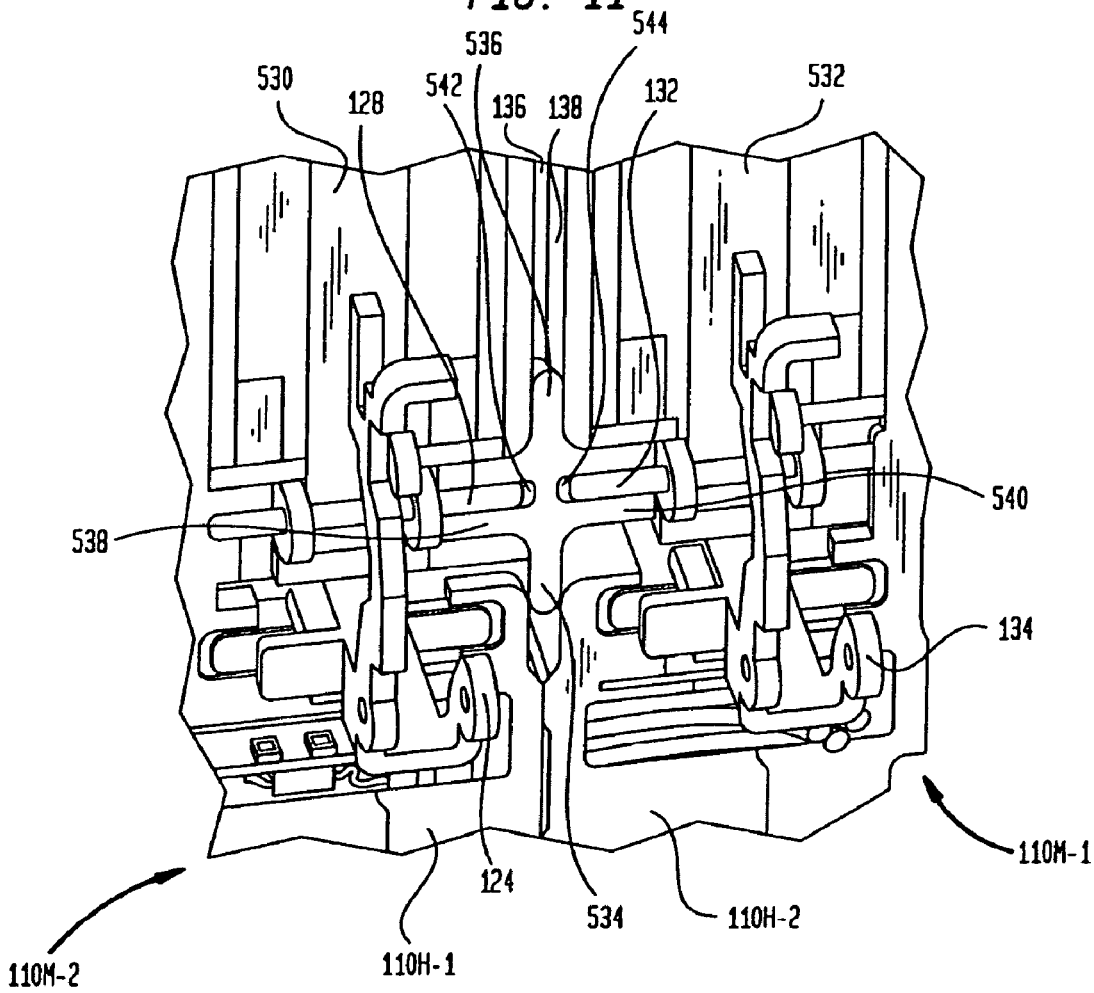
FIG. 11 is a detailed cutaway view of the two pole switching device of FIG. 6.
Figure 12:
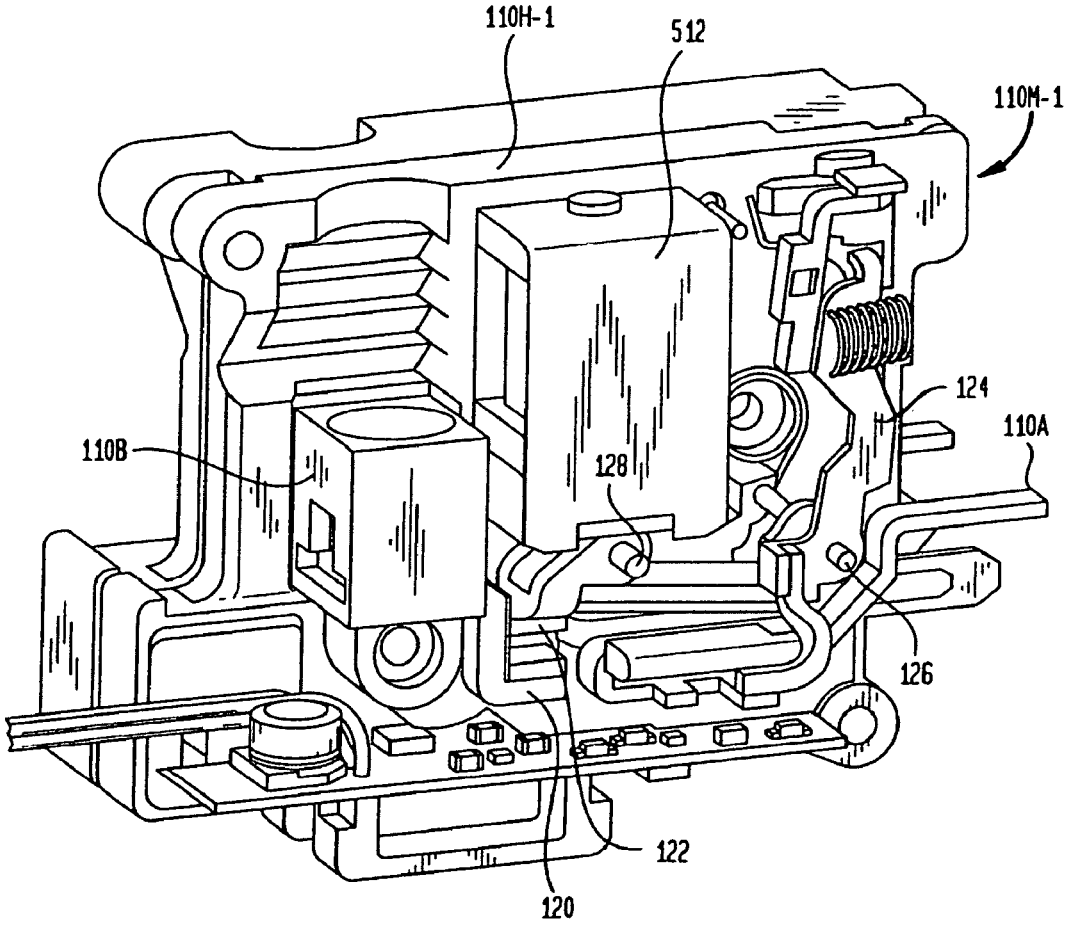
FIG. 12 is a perspective view of the first control module with one side of a housing removed.
Figure 13:
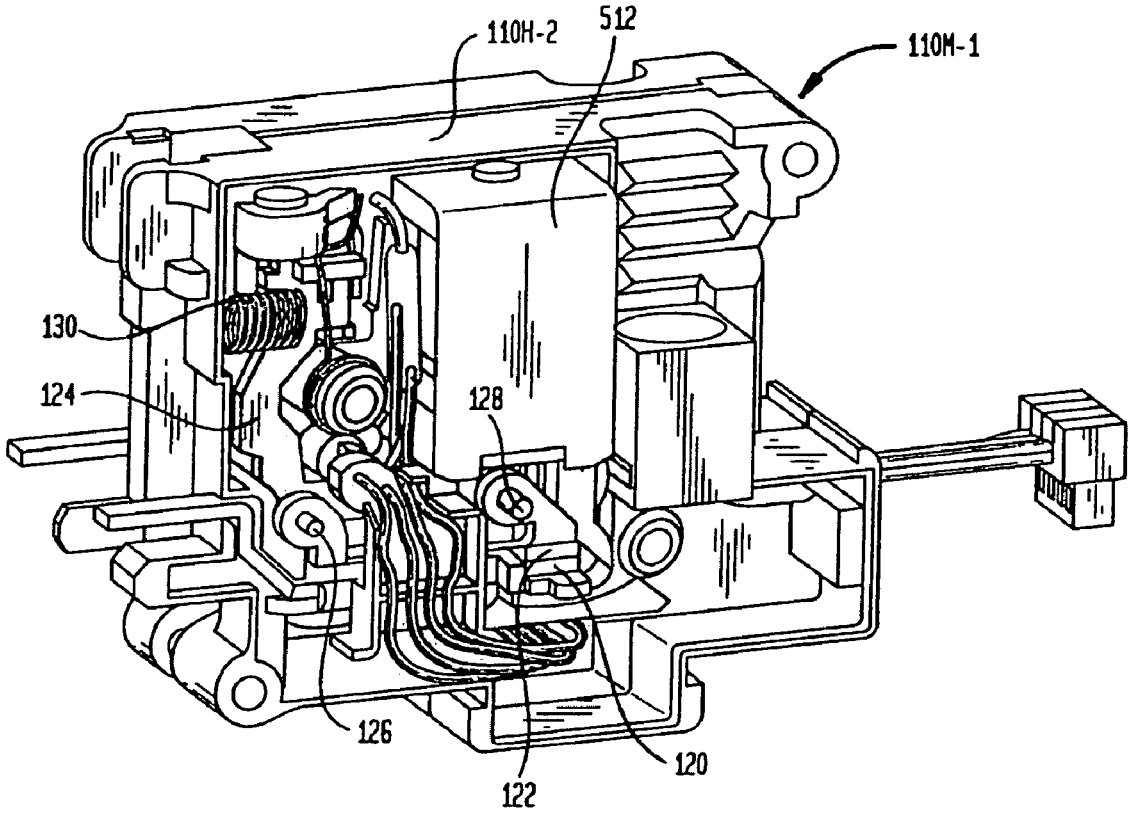
FIG. 13 is an opposite perspective view, relative to FIG. 12, of the first control module with another side of the housing removed.

The first control module electrical switch CR1-1, see FIG. 3, comprises a fixed contact 120 and a movable contact 122, see FIGS. 12 and 13. The movable contact 122 is carried on a contact arm 124 pivotally mounted in the housing 110H-1 at a contact arm pivot 126. A wrist pin 128 connects the contact arm 124 to the plunger 530, as is particularly illustrated in FIG. 11. An operating spring 130 biases the contact arm 124 so that normally the movable contact 122 is in electrical contact with the fixed contact 120, as shown in FIG. 13. When the solenoid 512 is latched, the plunger 512 raises the contact arm 124 via the wrist pin 128 to space the movable contact 122 from the fixed contact 120, as shown in FIG. 12.

The electromechanical structure of the second control module 110M-2 is generally similar to the first control module 110M-1 and is not described in detail. The second control module 110M-2 includes a wrist pin 132 mechanically linking the plunger 532 to a contact arm 134, see FIG. 11. As will be apparent, the contact arm 134 thus operates the second control module electrical switch CR2-1.

Figure 6:
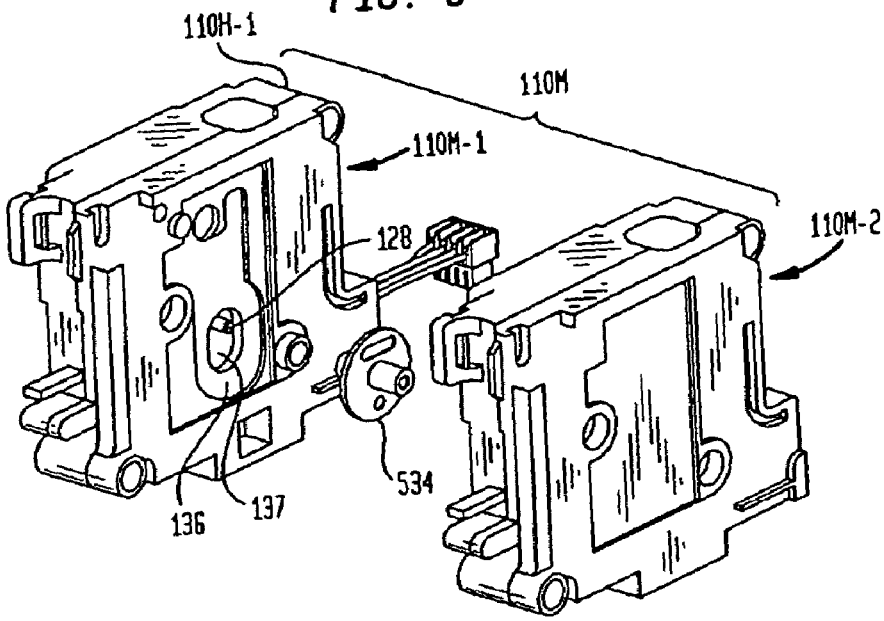
FIG. 6 is an exploded perspective view of a two pole switching device including a tie bar in accordance with the invention.
Figure 7:
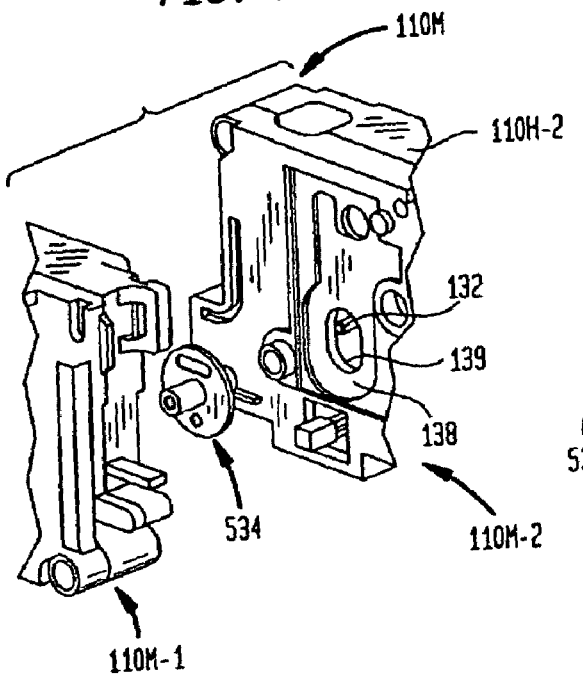
FIG. 7. is an exploded, partial perspective view of the two pole switching device of FIG. 6 taken from a different perspective.

The first control module housing 110H-1 includes a recess 136 surrounding an opening 137, see FIG. 6. The wrist pin 128 is accessible via the opening 137. The second control module housing 110H-2 includes a similar recess 138 surrounding an opening 139, see FIG. 7. The wrist pin 132 is accessible via the opening 139.

Figure 8:
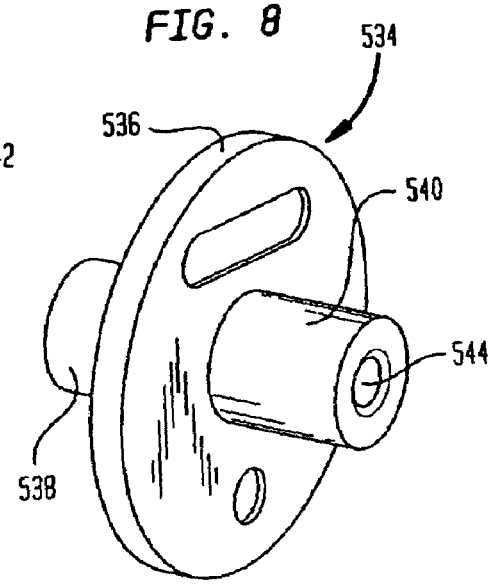
FIG. 8 is a perspective view of the tie bar in accordance with the invention.
Figure 9:
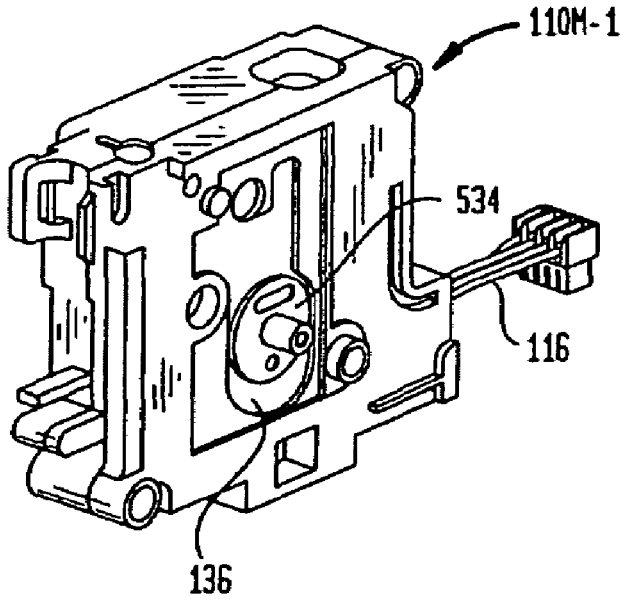
FIG. 9 is a perspective view of a first control module of the two pole switching device of FIG. 6 including the tie bar.
Figure 10:
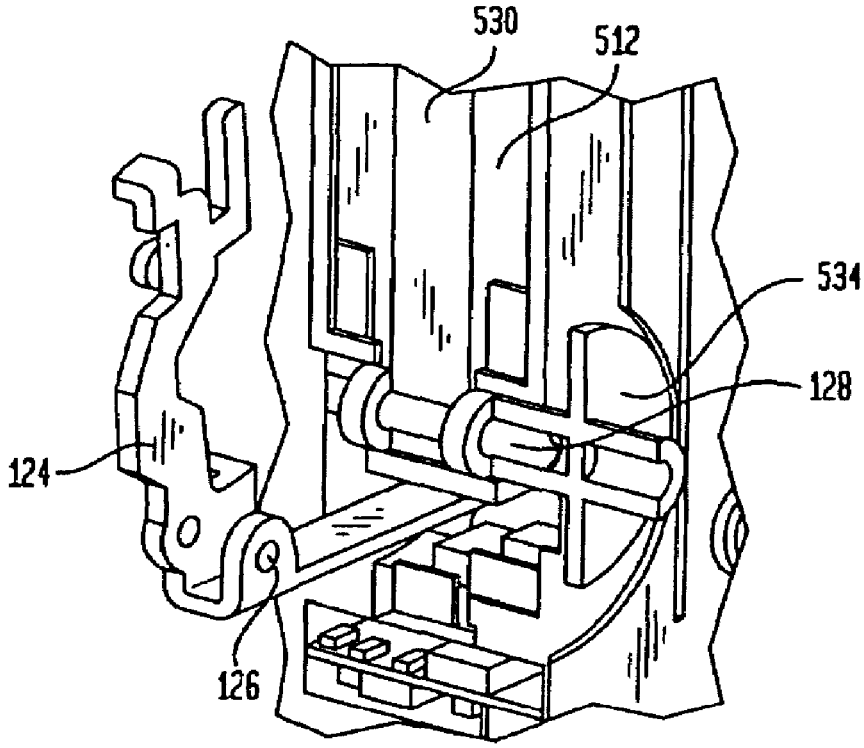
FIG. 10 is cutaway view of the first control module of FIG. 9.

Referring to FIG. 8, the tie bar 534 is of one piece plastic construction including a circular flange 536 having opposite tubular hubs or collars 538 and 540 with respective openings 542 and 544. The openings 542 and 544 selectively receive the respective wrist pins 128 and 132, as shown in FIG. 11.

Thus, as described, the tie bar 534 and the wrist pins 128 and 132 form a tie linkage to mechanically tie the plungers 530 and 532 and similarly, the contact arms 124 and 134, as is particularly illustrated in FIG. 11. The housings 110H-1 and 110H-2 sandwich the tie bar flange 536 within the recesses 136 and 138. As described above, the solenoid coils 512 and 514 are electrically operated together so that both poles are in the same operating position. In accordance with the invention, the tie bar 534 mechanically maintains the contact arms 132 and 134 in the same operating position by allowing at most minimal tilt of the tie bar 534. Thus, even if one of the coils 512 or 514 failed, the mechanical linkage insures that both poles are in the same operating position. Moreover, the flange 536 being seated in the recesses 136 and 138 blocks cross accumulation of debris between the individual control modules 110M-1 and 110M-2.

Thus, the multi-pole switching device 110M includes a single control circuit which simultaneously operates both control relays CR1 and CR2. This controls both to be in the same operating position. The disclosed tie linkage including the tie bar operatively connected to the wrist pins mechanically prevents the individual poles from being in different operating positions.

The general configuration of the control modules 110M-1 and 110M-2 is presented by way of example. The tie bar in accordance with the invention could be used with other configurations of relays or control modules adapted to form a multipole switching device. While the disclosed configuration is advantageously used in a distribution panel, the tie bar could similarly be used with stand-alone devices or the like.

I claim:

1. A multipole switching device for selectively switching electrical power from an electrical power source to a load circuit comprising:

a first control device comprising a housing, an electromechanical actuator in the housing including a moveable plunger, an electrical switch in the housing, and a first wrist pin disposed within the housing operatively connecting the plunger to the electrical switch, the housing having an opening proximate the first wrist pin;

a second control device comprising a housing mountable adjacent the first control device, an electromechanical actuator in the housing including a moveable plunger, an electrical switch in the housing, and a second wrist pin disposed within the housing operatively connecting the plunger to the electrical switch, the housing having an opening proximate the second wrist pin; and a tie linkage to mechanically tie the first control device plunger to the second control device plunger comprising first and second elongate collars extending into the respective first and second control device housings to telescopically receive the first and second wrist pins.

2. The multipole switching device of claim 1 wherein the tie linkage comprises a flange having opposite tubular hubs defining the first and second elongate collars receiving the first and second wrist pins.

3. The multipole switching device of claim 2 wherein the flange is sandwiched between the first control device housing and the second control device housing.

4. The multipole switching device of claim 3 wherein the flange is received in a recess in each of the first control device housing and the second control device housing.

5. The multipole switching device of claim 1 wherein the first wrist pin mechanically links the plunger to a contact arm of the first electrical switch and the second wrist pin mechanically links the plunger to a contact arm of the second electrical switch.

6. The multipole switching device of claim 1 wherein the electromechanical actuators comprise solenoids.

7. The multipole switching device of claim 1 wherein the tie linkage comprises a plastic tie bar.

8. A two pole switching device for selectively switching electrical power from an electrical power source to a load circuit comprising:

a first control module comprising a housing, an electromechanical actuator in the housing including a moveable plunger, an electrical switch in the housing comprising a fixed contact and a moveable contact, the moveable contact being carried on a contact arm, and a first wrist pin in the housing operatively connecting the plunger to the contact arm, the housing having an opening proximate the first wrist pin;

a second control module comprising a housing, an electromechanical actuator in the housing including a moveable plunger, an electrical switch in the housing comprising a fixed contact and a moveable contact, the moveable contact being carried on a contact arm, and a second wrist pin in the housing operatively connecting the plunger to the contact arm, the housing having an opening proximate the second wrist pin; and a tie linkage to mechanically tie the first control module contact arm to the second control module contact arm comprising first and second elongate collars extending into the respective first and second control device housings to telescopically receive the first and second wrist pins.

9. The two pole switching device of claim 8 wherein the tie linkage comprises a flange having opposite tubular hubs defining the first and second elongate collars receiving the first and second wrist pins.

10. The two pole switching device of claim 9 wherein the flange is sandwiched between the first control module housing and the second control module housing.

11. The two pole switching device of claim 10 wherein the flange is received in a recess in each of the first control module housing and the second control module housing.

12. The two pole switching device of claim 8 wherein the electromechanical actuators comprise solenoids.

13. The two pole switching device of claim 8 wherein the tie linkage comprises a plastic tie bar.

* * * * *